US009282395B1

(12) United States Patent
Daley

(10) Patent No.: US 9,282,395 B1
(45) Date of Patent: Mar. 8, 2016

(54) FLEXIBLE TRANSDUCER FOR SOFT-TISSUE AND ACOUSTIC AUDIO PRODUCTION

(71) Applicant: GOOGLE INC., Mountain View, CA (US)

(72) Inventor: Michael Daley, Santa Clara, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/503,997

(22) Filed: Oct. 1, 2014

Related U.S. Application Data

(60) Provisional application No. 61/892,123, filed on Oct. 17, 2013.

(51) Int. Cl.
*H04R 25/00* (2006.01)
*H04R 1/10* (2006.01)
*H04R 17/00* (2006.01)

(52) U.S. Cl.
CPC ..... *H04R 1/1058* (2013.01); *H04R 1/1016* (2013.01); *H04R 1/1066* (2013.01); *H04R 17/00* (2013.01); *H04R 25/505* (2013.01)

(58) Field of Classification Search
USPC ..... 381/381, 312, 190
See application file for complete search history.

(56) References Cited

U.S. PATENT DOCUMENTS

| | | | | |
|---|---|---|---|---|
| 3,594,514 | A | 7/1971 | Wingrove | |
| 7,760,898 | B2 * | 7/2010 | Howell et al. | 381/327 |
| 8,005,249 | B2 | 8/2011 | Wirola et al. | |
| 8,721,518 | B2 * | 5/2014 | Hellmuth et al. | 600/25 |
| 2004/0160571 | A1 * | 8/2004 | Jannard et al. | 351/158 |
| 2012/0237075 | A1 * | 9/2012 | East | H04R 1/1066 381/381 |
| 2013/0222235 | A1 * | 8/2013 | Abdollahi et al. | 345/156 |

FOREIGN PATENT DOCUMENTS

| | | | |
|---|---|---|---|
| JP | 2005-328125 | A | 11/2005 |
| WO | WO-2005/025267 | A1 | 3/2005 |
| WO | WO-2008/145949 | A1 | 12/2008 |
| WO | WO-2012/021424 | A1 | 2/2012 |

OTHER PUBLICATIONS

International Search Report and Written Opinion for Application No. PCT/US2014/06110, dated Jan. 21, 2015.

* cited by examiner

*Primary Examiner* — Davetta W Goins
*Assistant Examiner* — Amir Etesam
(74) *Attorney, Agent, or Firm* — Marshall, Gerstein & Borun LLP

(57) ABSTRACT

The present embodiments relate to techniques (300) and apparatuses (100, 500) for implementing a flexible transducer for soft-tissue audio production. These techniques (300) and apparatuses (100, 500) enable an audio-production device (102) having a flexible transducer (116, 402) conformed to a person's pinna to create audio within the person's external ear canal.

15 Claims, 5 Drawing Sheets

FLEXIBLE TRANSDUCER FOR SOFT-TISSUE AND ACOUSTIC AUDIO PRODUCTION

CROSS-REFERENCE TO RELATED APPLICATIONS

This application claims the benefit of U.S. Provisional Application No. 61/892,123, filed Oct. 17, 2013, which is incorporated by reference herein in its entirety.

FIELD

This application generally relates to audio production devices. In particular, the application relates to audio production devices having flexible electrical-to-mechanical (E-M) transducers.

BACKGROUND

This background description is provided for the purpose of generally presenting the context of the disclosure. Unless otherwise indicated herein, material described in this section is neither expressly nor impliedly admitted to be prior art to the present disclosure or the appended claims.

Sound speakers typically include an electromagnet and a paper or plastic cone whereby live or recorded audio, such as from optical disks, magnetic media, and radio and online feeds are converted from various formats into sound waves for people to hear. To better enable people to enjoy audio wherever they go, small speakers have been produced, such as over-ear headphones and in-ear ear-buds. These small speakers, however, plug or occlude people's ears, which can be uncomfortable and, in some cases, dangerous as they obscure ambient sounds that people may need to hear.

To address this problem, some current techniques have provided piezoelectric transducers that convert audio recordings and feeds into vibrations. These piezoelectric transducers, rather than excite a paper or plastic cone, directly contact a person's pinna of their outer ear. While these techniques often forgo plugging or occluding people's ears, they suffer from various signification drawbacks.

SUMMARY

In one embodiment, an audio-production device is provided. The audio-production device includes a flexible electrical-to-mechanical (E-M) transducer, a power source, one or more computer processors, and one or more computer-readable media having instructions stored thereon. Responsive to execution by the one or more computer processors, the instructions cause the power source to apply a voltage signal to the flexible E-M transducer effective to mechanically contract, expand, or bend the flexible E-M transducer to alter a shape of a pinna of a human ear, the alteration creating sound waves within an external auditory canal of the human ear.

In another embodiment, a method is provided. The method includes determining, based on audio data and characteristics of a flexible electrical-to-mechanical (E-M) transducer, a voltage signal to apply to the flexible E-M transducer, and applying the voltage signal to the flexible E-M transducer to mechanically contract, expand, or vibrate the flexible E-M transducer to alter a shape of a pinna of a human ear to which the flexible E-M transducer is conformed, the alteration of the shape creating sound waves in the human ear, the sound waves reproducing, in analog form, the audio data.

BRIEF DESCRIPTION OF THE DRAWINGS

Techniques and apparatuses enabling a flexible transducer for soft-tissue and acoustic audio production are described with reference to the following drawings. The same numbers are used throughout the drawings to reference like features and components.

DETAILED DESCRIPTION

Conventional audio devices that allow people to listen to audio while mobile include over-ear headphones, ear-buds, and piezoelectric transducers that contact the pinna of a person's outer ear. Headphones and ear buds occlude or plug a person's ear canal preventing the person from hearing ambient sound. Piezoelectric transducers that contact the pinna suffer from various significant drawbacks, including being uncomfortable, providing inaccurate sounds, and providing insufficient volume. Piezoelectric transducers generally include a rigid-surface contact that, for adequate accuracy and volume, is fitted with a tight pressure to the pinna. This can be a serious practical problem, as many people do not want a rigid contact to be tightly pressed to their ear. Other problems with piezoelectric transducers include poor impedance matching with human tissue and therefore have relatively high energy requirements due to low energy efficiencies, difficulties with producing bass sounds without tickling people's ears, and vibration-mode difficulties resulting from the generally small contact area with the pinna.

This disclosure describes techniques and apparatuses enabling a flexible transducer for soft-tissue audio production. The techniques conform the flexible transducer to a person's pinna and then create audio within the person's external ear canal without many of the problems of current piezoelectric transducers. Further, in some cases the techniques provide sound through the flexible transducer without pressing on the pinna, instead, the techniques flex the pinna to increase or decrease the pinna's concavity.

The following discussion first describes an operating environment, followed by techniques that may be employed in this environment, and ends with example apparatuses.

Operating Environment

Figure 1:
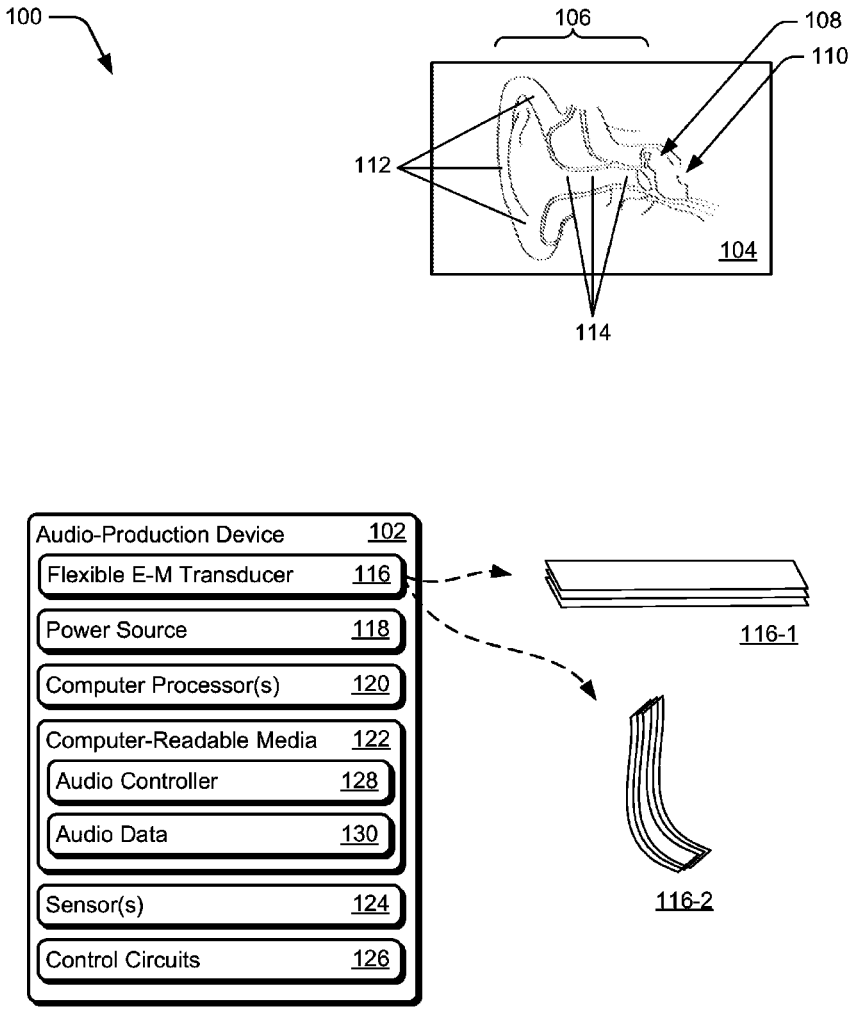
FIG. 1 illustrates an example environment in which a flexible transducer for soft-tissue and acoustic audio production can be enabled.

FIG. 1 illustrates an example environment 100 in which a flexible transducer for soft-tissue and acoustic audio production can be enabled. This example environment 100 includes an audio-production device 102 and a human ear 104.

Human ear 104 includes an outer ear 106, middle ear 108, and inner ear 110. Outer ear 106 includes pinna 112 and external auditory canal 114 (exaggerated for illustration). Pinna 112 is a visible part of the ear and is composed of an elastic cartilage connected to surrounding parts with ligaments and muscles and covered with skin. Pinna 112 has various regions, including the lobule (lobe), tragus, anti-tragus, helix, anti-helix, scapha, concha, and fossa triangularis (specific designations omitted for visual brevity).

Audio-production device 102 includes a flexible electrical-to-mechanical (E-M) transducer 116, a power source 118, one or more processors 120 (e.g., micro-processor core, embedded controller, or microcontroller), one or more computer-readable media 122, sensor(s) 124, and control circuits 126. In this particular example, flexible E-M transducer 116 is shown un-affixed to human ear 104 in order to show it more clearly, later figures will show implementation in which it is affixed. Example forms of flexible E-M transducer 116 include, and are shown as, unflexed form 116-1 and flexed form 116-2. Flexed form 116-2 shows a likely shape of flexible E-M transducer 116 when affixed and conforming to an anterior surface of pinna 112 of human ear 104.

Flexible E-M transducer 116 is capable of reacting to an applied voltage effective to convert electrical energy to mechanical energy. Flexible E-M transducer 116 can mechanically contract, expand, bend, twist, torque, shear, flex, and/or vibrate responsive to electrical energy applied. In some cases, flexible E-M transducer 116 includes multiple layers of ionic polymer gels, which can be transparent or opaque. These multiple layers can be designed to be thin, stretchable, and flexible, thereby enabling an easy and comfortable application or conformity to a person's pinna.

Each of the multiple layers of ionic polymer gel may have different E-M characteristics or properties that enable the multiple layers (e.g., multiple dissimilar layers), when electrical energy is applied, to produce a wide variety of mechanical forces. Alternately or additionally, flexible E-M transducer 116 may be fabricated from any suitable number of ionic polymer gel layers, which may be layered directly with adjacent other layers or separated with a suitable flexible substrate or membrane. For example, layers of ionic polymer gel may be separated by an insulating, semi-conductive, or conductive layer of flexible material (e.g., polymer or polyimide based materials).

In some embodiments, two or more ionic polymer gel layers of flexible E-M transducer 116 have electrical contacts by which electrical energy is applied at different locations. For example, some layers of the ionic polymer gel may have electrical contacts located at various longitudinal locations and other layers of the ionic polymer gel may have electrical contacts located at various latitudinal locations. In some cases, a layer of the ionic polymer gel may have a variety of electrical contacts at longitudinal and latitudinal locations that are same as, or different from, locations of electrical contacts on another layer. Having a wide array of electrical contacts at which electrical energy can be applied may be effective to enable precise or efficient control of mechanical action, and thus sound, produced by flexible E-M transducer 116.

Further, when using polymer gels (ionic or otherwise), or similarly composed adhesives (e.g., applied to external surfaces of flexible E-M transducer 116), the impedance match between the flexible E-M transducer 116 and human soft tissue can be very good. The impedance match reduces an amount of energy needed to create sound by mechanically actuating soft tissue (i.e., increasing efficiency) compared to many other devices, such as piezoelectric transducers, which have a poor impedance match with soft tissue.

Power source 118 can provide alternating, direct, or both types of current effective to apply a voltage to flexible E-M transducer 116. Power source 118 can be wired or wireless (e.g., inductive), and be integral with or separate from flexible E-M transducer 116 or other elements of audio-production device 102. In this example environment, power source 118 is electrically connected to flexible E-M transducer 116 through control circuits 126 of audio-production device 102.

Control circuits 126 include one or more of input/output controllers or wireless transmitters or transceivers (e.g., personal-area network or Bluetooth). In some embodiments, control circuits 126 may generate waveforms of current (or voltage) that are applied to flexible E-M transducer 116 by modulating current (or voltage) provided by power source 118. The waveforms of current that apply electrical energy to flexible E-M transducer 116 may be generated using any suitable current (or voltage) switching or modulation, such as pulse-width modulation, amplitude modulation, frequency modulation, and the like (or a combination thereof).

Computer-readable media 122 includes audio controller 128 and audio data 130, which can include files, configuration settings (default or user specified), and/or cached streaming media. Audio controller 128 is capable of controlling components of audio-production device 102, including flexible E-M transducer 116, effective to create sound waves in a person's ear. More specifically, audio controller 128 is capable of determining a voltage signal to apply to flexible E-M transducer 116 to reproduce audio of an audio file or stream (e.g., audio data 130). Audio controller 128 causes power source 118 to apply this voltage signal to flexible E-M transducer 116 effective to mechanically contract, expand, or bend flexible E-M transducer 116. When affixed to pinna 112 of human ear 104, this mechanical control alters a shape of the pinna, the alteration creating sound waves audible to that person and representing audio data 130, such as music, a person talking, and computer-alert sounds.

Figure 2:
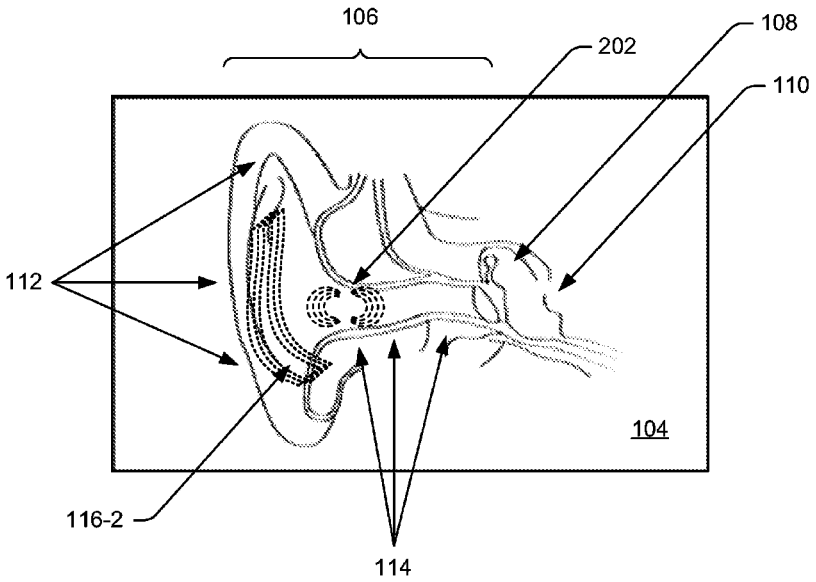
FIG. 2 illustrates an implementation of a flexible transducer conformed to an anterior surface of a human ear's pinna in accordance with one or more embodiments.

This is illustrated in FIG. 2, which shows an audio dipole 202 within external auditory canal 114 of human ear 104. This audio dipole 202 produces the sound waves received by middle ear 108 and inner ear 110, effective for the person to hear the audio. Note also flexed form 116-2 of flexible E-M transducer 116, which is shown conformed to and affixed to an anterior (backside, shown in dashed lines) of pinna 112.

It is to be appreciated and understood that, although reference is made to producing sound waves, mechanical motions of flexible E-M transducer 116 may also be described as producing vibrations that traverse pinna 112 and other parts of the human ear, which are then 'heard' as sound by a person's inner ear. Thus, the mechanical motions and vibrations may be any suitable type of mechanical signal having frequency components within an audible frequency range of a person (e.g., approximately 20 Hz-15 KHz).

As noted in part above, applying the voltage signal to flexible E-M transducer 116 can cause it to mechanically contract or expand, which in turn alters the shape of pinna 112. This alteration can include the pinna becoming more concave or less concave than an original shape of the pinna. Assume, for example, that a curved portion of flexed form 116-2 covers the back of the concha part of pinna 112. The concha is bowl-like and concave. By contracting or expanding flexible E-M transducer 116, the concha becomes more or less concave, thereby producing audio dipole 202 through a squeezing-and-releasing (or squeezing-and-spreading) of the concave portion of pinna 112 rather than some transducers that instead hit or strike a small portion of a pinna.

Note the size of flexible E-M transducer 116 as shown at 116-1 and 116-2. While not required to be this size (relative human ear 104), as larger or smaller sizes can be used, this size covers a substantial amount of pinna 112 surface area from a back-side of human ear 104. This large size enables good low-frequency conduction, larger volume with a lower stroke (than small-surface contact transducers), and, in some cases, reduces the effect of negative and positive vibration modes. A negative vibration mode can be caused when a small contact area (relative to the object's size being vibrated)

causes harmonic vibrations that cancel out some other vibrations, thereby decreasing volume of those other vibrations. A positive vibration mode can also be a problem when harmonic vibrations add to the amplitude of other vibrations, thereby overly increasing volume in the other vibration being amplified.

Note also that audio-production device 102 can be implemented in conjunction with, or include, many different types of computing or electronic devices capable of providing control and power to a flexible E-M transducer, such as a smart phone, notebook computer, smart-watch, tablet computer, personal media player, personal navigating device (e.g., global positioning system), gaming console, desktop computer, video camera, wearable computing spectacles, wearable computing collar (a necklace-like device), or portable gaming device.

Furthermore, audio-production device 102 may also include communication transceivers, such as near-field communication (NFC) transceivers, wireless personal-area-network (WPAN) transceivers, wireless local-area-network (WLAN), or wireless wide-area-network (WWAN) transceivers and so forth through which flexible E-M transducer 116 may be controlled or receive audio data.

In some cases, audio-production device 102 includes one or more sensors 124. Sensors 124 sense various properties, variances, stimuli, or characteristics of an environment, such as temperature, pinna stiffness or flexibility, sound waves, and so forth. Sound captured by sensors 124 may be analyzed or measured for any suitable component, such as pitch, timbre, harmonics, loudness, rhythm, envelope characteristics (e.g., attack, sustain, decay), and so on. In some embodiments, audio-production device 102 alters voltage signals used based on audio input received from sensors 124.

Generally, audio controller 128 may produce more-accurate sounds based on input about ambient conditions, ear characteristics, and errors. For example, audio controller 128 may implement ambient noise cancellation based on ambient acoustic data received from sensors 124. Error correction is described as part of various methods below. This discussion now turns to example methods enabling flexible transducers for soft-tissue audio production.

Example Methods

Figure 3:
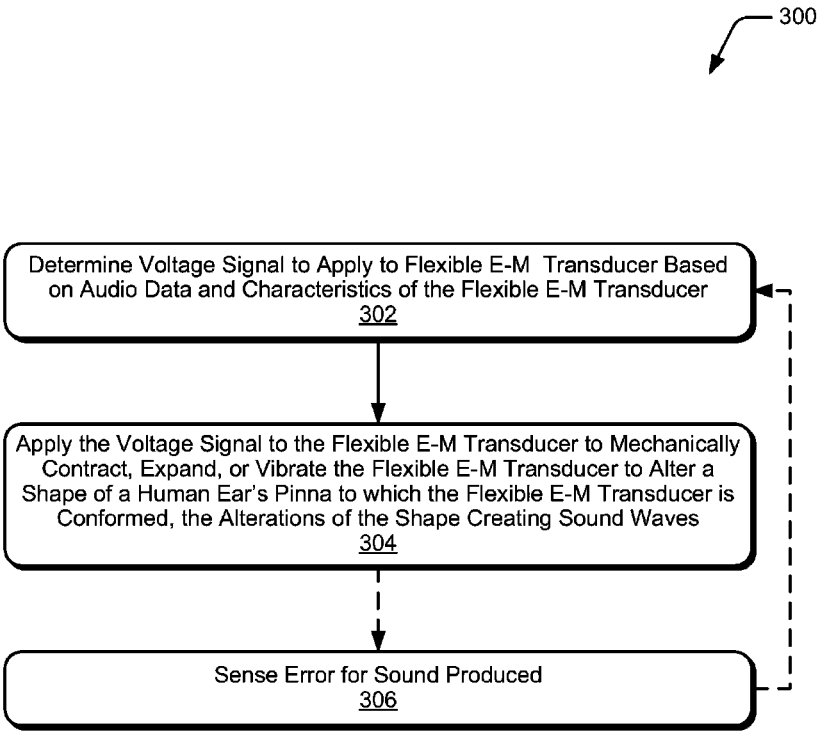
FIG. 3 illustrates a method for soft-tissue audio production in accordance with one or more embodiments.

The following discussion describes methods by which techniques are implemented to enable soft-tissue audio production using a flexible transducer. These methods can be implemented utilizing the previously described environment, such as shown in FIGS. 1 and 2. Aspects of these example methods are illustrated in FIG. 3, which are shown as operations performed by one or more entities. The orders in which operations of these methods are shown and/or described are not intended to be construed as a limitation, and any number or combination of the described method operations can be combined in any order to implement a method, or an alternate method.

FIG. 3 illustrates an example method 300 enabling soft-tissue audio production through a flexible E-M transducer. At 302, a voltage signal to apply to a flexible E-M transducer is determined based on an audio file or stream. The voltage signal may also be determined based on characteristics of a flexible electrical-to-mechanical (E-M) transducer to which the signal is applied.

Assume, for example, that audio data 130 of FIG. 1 includes *Mozart's Symphony* #40 *in G Minor*, which includes high and low pitches, large variances in volume, many different sounds from different instruments, and so forth. At 302, audio controller 128 determines a voltage signal to apply effective to reproduce *Mozart's Symphony* #40 *in G Minor* through flexible E-M transducer 116.

This voltage signal can also be based on other factors, such as ambient conditions and ear characteristics. Thus, audio controller 128 may take into account a current air temperature, humidity, barometric pressure, and so forth, as these may affect sound propagation and/or characteristics of flexible E-M transducer 116. Ear characteristics may also be taken into account, such as a stiffness of a pinna, a concavity or lack thereof, an impedance match between flexible E-M transducer 116 and the ear, and so forth.

At 304, the voltage signal is applied to the flexible E-M transducer to mechanically contract, expand, or vibrate the flexible E-M transducer effective to alter a shape of a human ear's pinna to which the flexible E-M transducer is conformed. This alteration of the shape of the pinna creates sound waves in the human ear, the sound waves reproducing, in analog form, the audio file or stream.

In the ongoing example, audio controller 128 applies the electrical signal corresponding to *Mozart's Symphony* #40 *in G Minor* to flexible E-M transducer 116. In this particular example, audio controller 128 generates the electrical signal via control circuits 126 to begin *Mozart's Symphony* #40 *in G Minor*, which applies the electrical signal to flexible E-M transducer 116 by controlling voltage or current provided by power source 118. The application of this electrical signal to flexible E-M transducer 116 begins *Mozart's Symphony* #40 *in G Minor*, which the person then enjoys, here in relative comfort and without having his or her ear occluded or plugged.

In some cases, however, errors can be sensed. In such cases, methods 300 proceed from 304 to 306. At 306, an error is sensed for the sound waves being produced.

These errors can be sensed, such as by sensor 124, in the sound waves currently being produced (e.g., *Mozart's Symphony* #40 *in G Minor*) or prior sound waves. The error may represent a mismatch between expected sound waves and sensed sound waves. In the case of audio currently being produced, the error sensed can be sensed in real time and corrected in real time. In some other cases, a large and/or sophisticated sensor (e.g., an in-ear or near-ear microphone) can be used, such as during a set-up operation whereby various detailed characteristics specific to the person's ear are sensed. This can aid in calibrating audio-production device 102 to address variances in people's ear structures, where flexible E-M transducer is placed on the person's ear, and so forth. In such cases, calibration or setting information can be stored in audio data 130 for use by audio controller 128 to generate electrical signals calibrated to a person's ear.

After sensing the sound waves and thus determining an error, methods 300 return to 302 at which point determining the voltage signal is further based on the sensed error to correct the error in the sound waves. This feedback loop can continue in real time for ever-higher accuracy in audio being produced.

Concluding the ongoing example, assume that, due to a non-standard stiffness of the person's anti-helix over which a portion of flexible E-M transducer 116 is conformed results in a particular pitch—"A" above middle "C" in the diatonic scale (440 Hz)—has a lower amplitude than expected. Based on this error, audio controller 128 alters the voltage signal to increase the volume for this wavelength.

Note, however, that sensing an error may involve various determinations not shown in FIG. 3 for visual simplicity. These may include, for example, sensing an audio dipole within an external auditory canal (e.g., audio dipole 202 within external auditory canal 114 both of FIG. 2). Audio controller 128 can then compare the sensed audio dipole with an audio dipole intended to be created within the external auditory canal. With this comparison, audio controller 128 may determine, based on the error, a voltage correction or calibration to correct the error effective to cause a future sensed audio dipole to more-closely match a future intended audio dipole created within the external auditory canal. In either case, or even if the error is not corrected, audio controller 128 may provide the error to an entity (e.g., one associated with audio-production device 102) effective to enable reduction of future errors for this or future devices produced with flexible E-M transducers.

The above techniques and apparatuses are described in the context of a single flexible E-M transducer. In some cases, however, multiple flexible E-M transducers or a multi-region E-M transducer can be used.

Figure 4:
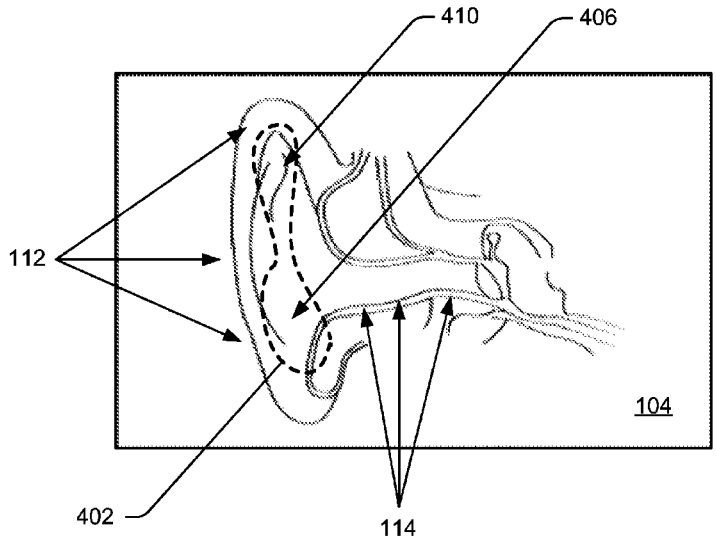
FIG. 4 illustrates an example implementation of a multi-region flexible transducer capable of soft-tissue audio production.
Figure 4:
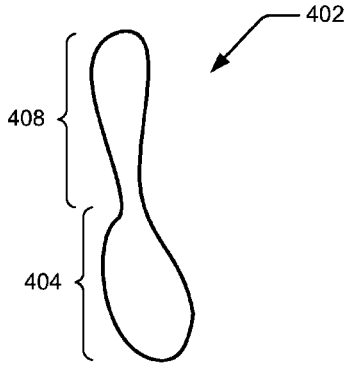

Consider, by way of example, FIG. 4, which illustrates a multi-region flexible E-M transducer 402 (shown affixed and in enlarged form) having a first region 404 conformed to one portion of a person's pinna 112 (here to the back of concha 406) and a second region 408 conformed to another portion of the person's pinna 112 (here to anti-helix 410). As noted in part above, different portions of a pinna may have different characteristics, such that when mechanically excited, each produces different sound wavelengths. Thus, one part of a pinna may better produce high pitches and another low pitches.

Consider, for example, the two regions of flexible E-M transducer 402. And assume that each of these regions can be provided different voltage signals—thus, audio controller 128 causes power source 118 to apply a first voltage to first region 404 of flexible E-M transducer 402 effective to mechanically contract or expand concha 406 of pinna 112 to create a first audio dipole within external auditory canal 114. Similarly, audio controller 128 causes power source 118 to apply a second voltage to second region 408 of flexible E-M transducer 402 effective to mechanically contract or expand anti-helix 410 of pinna 112 to create a second audio dipole within external auditory canal 114. Audio controller 128 may do so to for various reasons, including to create complementary first and second dipoles so that some sound waves are magnified, or to have one dipole cancel part of the other dipole. Note also that these regions may overlap—one may include most or all of flexible E-M transducer and the other a portion of it such that one part of the flexible E-M transducer includes a second voltage signal to alter the behavior of that region and thus the corresponding portion of the ear to which it is conformed.

Example Electronic Device

Figure 5:
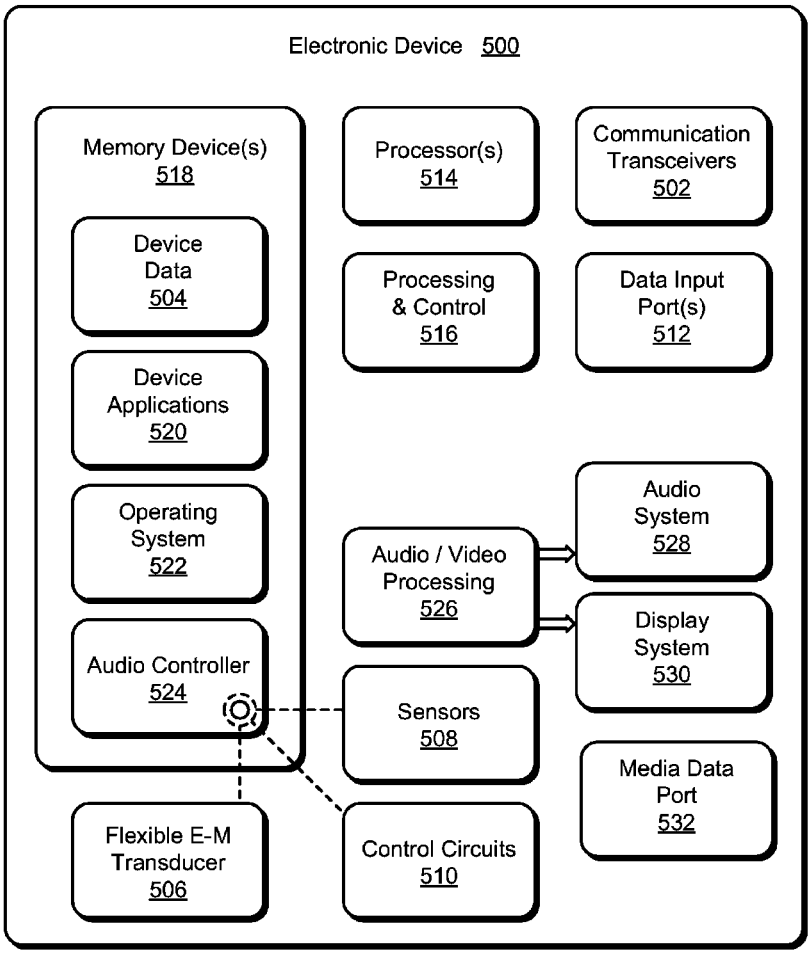
FIG. 5 illustrates various components of an electronic device that can implement a flexible transducer for soft-tissue and acoustic audio production in accordance with one or more embodiments.

FIG. 5 illustrates various components of an example electronic device 500 that can be implemented as an audio-production device as described with reference to any of the previous FIGS. 1-4. The device may be implemented as any one or combination of a fixed or mobile device, in any form of a consumer, computer, portable, user, communication, phone, navigation, gaming, audio, messaging, Web browsing, paging, media playback, and/or other type of electronic device, such as the audio-production device 102 described with reference to FIG. 1.

Electronic device 500 includes communication transceivers 502 that enable wired and/or wireless communication of device data 504, such as received data, transmitted data, or audio data 130 as described with reference to FIG. 1. Example communication transceivers include NFC transceivers, WPAN radios compliant with various IEEE 802.15 (Bluetooth™) standards, WLAN radios compliant with any of the various IEEE 802.11 (WiFi) standards, WWAN (3GPP-compliant) radios for cellular telephony, wireless metropolitan area network (WMAN) radios compliant with various IEEE 802.16 (WiMAX) standards, and wired local area network (LAN) Ethernet transceivers.

In embodiments, the electronic device 500 includes flexible E-M transducer 506, such as flexible E-M transducer 116 or 402 as described with reference to FIG. 1 or 4. The electronic device 500 may also include sensors 506 and control circuitry 508, such as sensors 124 and control circuits 126 as described with reference to FIG. 1. Flexible E-M transducer 506, sensors 508, and control circuits 510 can be implemented to enable a flexible transducer for soft-tissue audio production.

Electronic device 500 may also include one or more data input ports 512 via which any type of data, media content, and/or inputs can be received, such as user-selectable inputs, messages, music, television content, recorded video content, and any other type of audio, video, and/or image data received from any content and/or data source. Data input ports 512 may include USB ports, coaxial cable ports, and other serial or parallel connectors (including internal connectors) for flash memory, DVDs, CDs, and the like. These data input ports may be used to couple the electronic device to components, peripherals, or accessories such as keyboards, microphones, or cameras.

Electronic device 500 of this example includes processor system 514 (e.g., any of application processors, microprocessors, digital-signal-processors, controllers, and the like), or a processor and memory system (e.g., implemented in a SoC), which process (i.e., execute) computer-executable instructions to control operation of the device. Processor system 514 (processor(s) 514) may be implemented as an application processor, embedded controller, microcontroller, and the like. A processing system may be implemented at least partially in hardware, which can include components of an integrated circuit or on-chip system, digital-signal processor (DSP), application-specific integrated circuit (ASIC), field-programmable gate array (FPGA), a complex programmable logic device (CPLD), and other implementations in silicon and/or other hardware. Alternatively or in addition, the electronic device can be implemented with any one or combination of software, hardware, firmware, or fixed logic circuitry that is implemented in connection with processing and control circuits, which are generally identified at 516 (processing and control 516). Although not shown, electronic device 500 can include a system bus, crossbar, or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Electronic device 500 also includes one or more memory devices 518 that enable data storage, examples of which include random access memory (RAM), non-volatile memory (e.g., read-only memory (ROM), flash memory, EPROM, EEPROM, etc.), and a disk storage device. Memory device(s) 518 provide data storage mechanisms to store the device data 504, other types of information and/or data, and various device applications 520 (e.g., software applications). For example, operating system 522 can be maintained as software instructions within memory device 518 and executed by processors 514. In some aspects, audio controller 524 is embodied in memory devices 518 of electronic device 500 as executable instructions or code. Although represented as a software implementation, audio controller 524 may be implemented as any form of a control application, software application, signal-processing and control module, firmware that is installed on the device, a hardware implementation of the controller, and so on.

Electronic device 500 also includes audio and/or video processing system 526 that processes audio data and/or passes through the audio and video data to audio system 528 and/or to display system 530 (e.g., spectacles). Audio system 528 and/or display system 530 may include any devices that process, display, and/or otherwise render audio, video, display, and/or image data. Display data and audio signals can be communicated to an audio component and/or to a display component via an RF (radio frequency) link, S-video link, HDMI (high-definition multimedia interface), composite video link, component video link, DVI (digital video interface), analog audio connection, or other similar communication link, such as media data port 532. In some implementations, audio system 528 and/or display system 530 are external components to electronic device 500. Alternatively or additionally, display system 530 can be an integrated component of the example electronic device, such as part of an integrated touch interface. As described above, audio controller 524 may use audio system 528, or components thereof, in some aspects of implementing a flexible transducer for soft-tissue production.

Although embodiments of a flexible transducer for soft-tissue audio production have been described in language specific to features and/or methods, the subject of the appended claims is not necessarily limited to the specific features or methods described. Rather, the specific features and methods are disclosed as example implementations a flexible transducer for soft-tissue audio production.

What is claimed is:

1. An audio-production device comprising:

a flexible electrical-to-mechanical (E-M) transducer including a first region and a second region;

a power source;

one or more computer processors; and one or more computer-readable media having instructions stored thereon that, responsive to execution by the one or more computer processors, cause the power source to:

apply a first voltage signal to the first region of the flexible E-M transducer effective to mechanically contract or expand the first region of the flexible E-M transducer effective to alter a first shape of a first portion of a pinna of a human ear to create a first audio dipole within an external auditory canal of the human ear, and apply a second voltage signal to the second region of the flexible E-M transducer effective to mechanically contract or expand the second region of the flexible E-M transducer effective to alter a second shape of a second portion of the pinna to create a second audio dipole within the external auditory canal.

2. The audio-production device as recited in claim 1, wherein the flexible E-M transducer comprises multiple gels having an impedance similar to human soft-tissue impedance.

3. The audio-production device as recited in claim 2, wherein the multiple gels are ionic polymers.

4. The audio-production device as recited in claim 1, wherein the flexible E-M transducer is a stretchable ionic transparent transducer.

5. The audio-production device as recited in claim 1, wherein the audio-production device operates without occluding or plugging the external auditory canal.

6. The audio-production device as recited in claim 1, wherein causing the power source to alter the first shape of the first portion of the pinna and the second shape of the second portion of the pinna causes the pinna to be either more concave or less concave than an original shape of the pinna.

7. The audio-production device as recited in claim 1, wherein causing the power source to apply the first voltage signal and the second voltage signal to the flexible E-M transducer causes the flexible E-M transducer to squeeze and release or spread the pinna.

8. The audio-production device as recited in claim 1, wherein the first region and the second region overlap.

9. The audio-production device as recited in claim 1, wherein the first audio dipole and the second audio dipole are complimentary.

10. The audio-production device as recited in claim 1, wherein the first audio dipole is effective to cancel part of the second audio dipole.

11. The audio-production device as recited in claim 1, wherein the first portion of the pinna and the second portion of the pinna, when mechanically contracted or expanded, produce different sound wavelengths.

12. The audio-production device as recited in claim 1, wherein the power source wirelessly provides the first voltage signal and the second voltage signal to the flexible E-M transducer.

13. The audio-production device as recited in claim 1, wherein a near-field of the first audio dipole is within the external auditory canal and a far-field of the first audio dipole is outside of the human ear effective to create low-volume sound outside the human ear and high-volume sound inside the external auditory canal.

14. The audio-production device as recited in claim 1, wherein the audio-production device further comprises a sensor capable of sensing the first audio dipole and wherein the instructions, responsive to execution by the one or more processors, further:

determine an error by comparing the sensed first audio dipole and an audio dipole intended to be created within the external auditory canal, and determine, based on the error, a voltage correction and applying the voltage correction, or provide the error to an entity effective to enable reduction of future errors.

15. The audio-production device as recited in claim 1, wherein the instructions, responsive to execution by the one or more processors, further determine, based on audio data, the first voltage signal and the second voltage signal to apply effective to create music corresponding to the audio data and within the external auditory canal.

* * * * *